United States Patent [19]

Dibrell

[11] Patent Number: 4,513,575

[45] Date of Patent: Apr. 30, 1985

[54] CENTRIFUGAL PISTON EXPANDER

[75] Inventor: Edwin W. Dibrell, San Antonio, Tex.

[73] Assignee: Centrifugal Piston Expander, Inc., San Antonio, Tex.

[21] Appl. No.: 554,408

[22] Filed: Nov. 22, 1983

Related U.S. Application Data

[63] Continuation-in-part of Ser. No. 436,412, Oct. 25, 1982, Pat. No. 4,449,379, and Ser. No. 451,606, Dec. 20, 1982, Pat. No. 4,420,945.

[51] Int. Cl.[3] ..... F25B 9/00

[52] U.S. Cl. ..... 62/86; 62/402; 62/499; 165/86

[58] Field of Search ..... 62/86, 402, 499; 165/86

[56] References Cited

U.S. PATENT DOCUMENTS 4,022,032 5/1977 Nott ..... 62/499

*Primary Examiner*—Ronald C. Capossela

*Attorney, Agent, or Firm*—Norvell & Associates

[57] ABSTRACT

The improved method and apparatus for operating a centrifugal piston expander of the type wherein a free piston is mounted in a rotating fluid pressure chamber having a longitudinal axis that is non-radial with respect to the axis of rotation, but extends from a position remote from the rotation axis to a position proximate to the rotation axis. To bring the free piston to a cushioned stop when it is moving radially inwardly under the influence of applied gas pressure, a normally open exhaust valve in the inner end of the fluid pressure chamber is closed to trap a column of gas in the path of the oncoming piston. After the inward motion of the piston is arrested, the valve may be opened to exhaust the trapped gas or may be maintained closed for a brief period to permit the energy stored in the trapped gas to initiate the acceleration of the piston in its return outward movement.

9 Claims, 5 Drawing Figures

CENTRIFUGAL PISTON EXPANDER

RELATIONSHIP TO PENDING APPLICATIONS

This application constitutes a continuation-in-part of my co-pending application Ser. No. 436,412, filed Oct. 25, 1982 now U.S. Pat. No. 4,449,379, and Ser. No. 451,606, filed Dec. 20, 1982 now U.S. Pat. No. 4,420,945, each of said applications being assigned to the Assignee of this application.

BACKGROUND OF THE INVENTION

1. Field of the Invention

The invention relates to a method and apparatus for extracting heat and mechanical energy from a pressured gas by expanding same in a rotating fluid pressure chamber containing a free piston.

2. Description of the Prior Art

In my above identified co-pending applications, which do not constitute prior art, there are disclosed a variety of forms of centrifugal piston expanders. Such disclosed expanders comprise a rotating body upon which one or more cylinders are mounted for co-rotation. Each cylinder defines a fluid pressure chamber extending from a point remote from the axis of rotation of the rotating body to a point proximate to the axis of rotation. The longitudinal axis of the fluid pressure chamber may be linear or arcuate but, in any event, no substantial portion of the longitudinal axis is radially disposed with respect to the rotational axis.

A free piston is mounted within the cylinder for sliding sealable movements through the pressure chamber. Inlet valves are respectively provided in the outermost ends of the cylinders through which charges of a pressured gas may be introduced into the fluid pressure chambers, which results in driving the pistons radially inwardly toward the axis of rotation by expansion of the pressured gas. The reaction force of the gas on the outermost end of the cylinder produces a torque to assist in the rotation of the rotating body. A motor is employed for use as required to obtain a speed of rotation sufficient to insure the return of the free pistons to the outermost ends of the fluid pressure chambers due to the action of centrifugal force. Said motor may also function as a generator, as known to those skilled in the art. Exhaust valves in the outer ends of the cylinders open during the return movement of the free pistons to supply the cooled, expanded gas to a heat exchanger, or, if the gas is air, to a room.

In an attempt to optimize the performance of these types of centrifugal piston expanders, a computer analysis was undertaken to permit calculation of torque output and piston speed as a function of the diameter and longitudinal length of the fluid pressure chamber, rate of rotation of the cylinder, the weight of the piston, the pressure of the gas supplied to the pressure chamber and the time of application. Such computer analysis surprisingly indicated that for some combinations of the aforementioned variables, the centrifugal force acting on the piston was insufficient to arrest the inward movement of the piston, with the result that it would slam into the inner end wall or stop ring of its cylinder which, of course, is an undesirable condition.

SUMMARY OF THE INVENTION

This invention provides modified form of centrifugal piston expander in that the innermost end of the fluid pressure chamber defined by the rotating cylinders is effectively closed prior to the arrival of the free piston at such innermost end. Such closing can, of course, be accomplished by a normally open exhaust valve which is actuated to a closed position in response to the position of the approaching free piston in the same manner as described in the above referred to pending applications. The closing of such valve has the effect of trapping a quantity of gas, which is generally the ambient air, between the closed inner end wall of the fluid pressure chamber and the oncoming free piston, thus providing for a cushioned stop of such free piston. Once the inward motion of the free piston is arrested, the existing high pressure in the trapped gas can be released to atmosphere or can be permitted to operate on the piston to assist centrifugal force in returning the free piston to its outermost position where it will receive a new charge of pressured gas through the operation of valving mechanisms described in the aforementioned co-pending applications.

Whenever a plurality of cylinders are employed, the inner ends of such cylinders may be interconnected by small conduits and a single valve connected to such conduits may be closed to build up a gas column opposing the inward movement of the free pistons, thus stopping the pistons without damage.

A preliminary computer analysis of several configurations of centrifugal piston expanders embodying this invention revealed that for many combinations of variables, such as overall diameter of the device, internal diameter of the cylinders, length of piston stroke, weight of the piston, speed of rotation, and magnitude and duration of applied gas pressure, the resulting torque developed by the expander was characterized by cyclically reversing torques. This in turn would result in a cyclically varying speed of rotation of the output shaft, representing a mechanical power source having unusual characteristics. An expander embodying this invention could be used to drive a "smart generator" (computer controlled generator/alternator and known to those skilled in the art) to produce usable direct or alternating electrical current from the cyclically varying rotational speed produced by the centrifugal piston expander.

Further advantages of this invention will become readily apparent to those skilled in the art from the following detailed description, taken in conjunction with the annexed sheets of drawings, on which are shown several embodiments of the invention.

DESCRIPTION OF PREFERRED EMBODIMENTS

Figure 2:
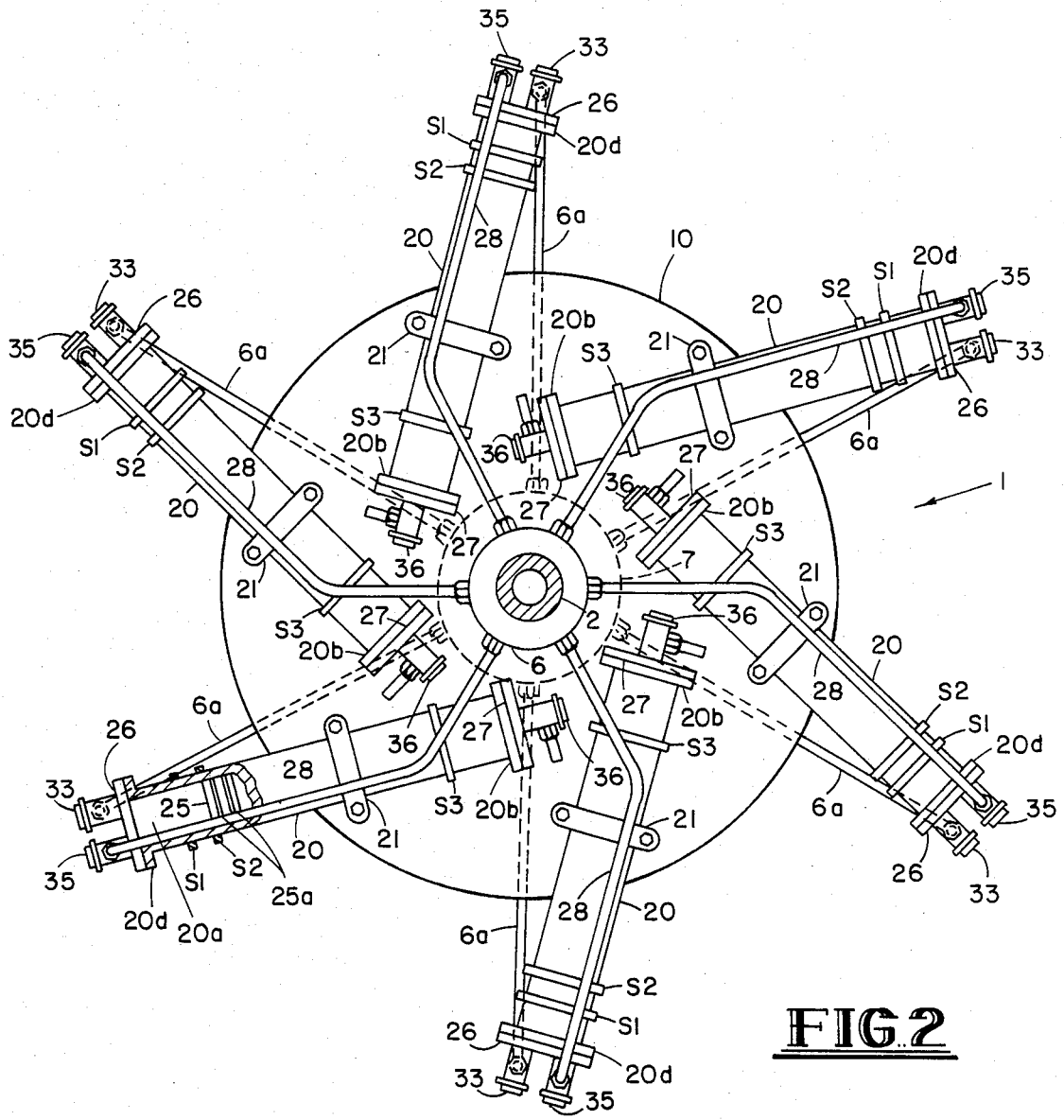
FIG. 2 is a sectional view taken on the plane 2—2 of FIG. 1.
Figure 1:
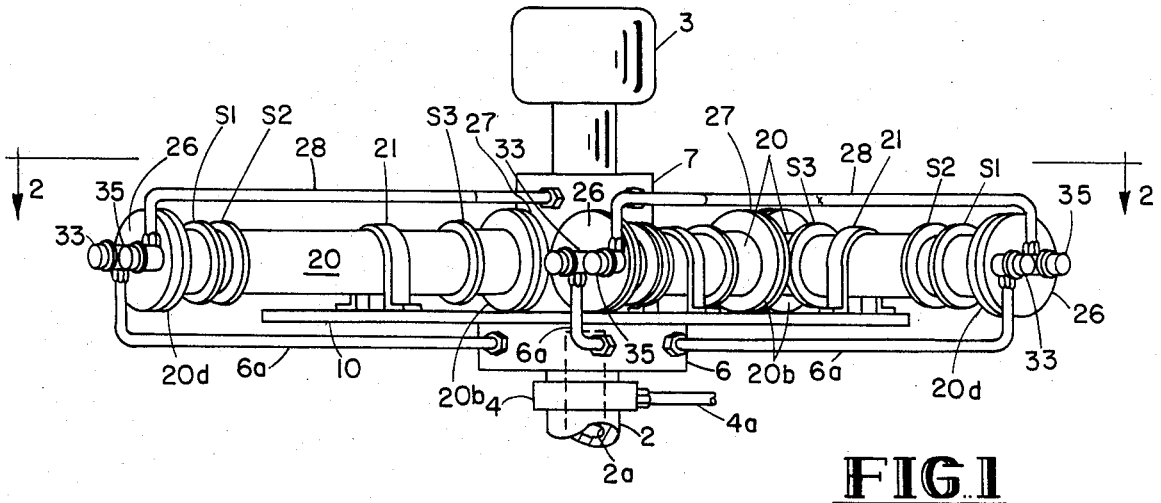
FIG. 1 is a schematic elevational view, partly in section, of a centrifugal piston expander embodying this invention and employing rotatable cylinders having a linear longitudinal axis.

Referring now to FIGS. 1 and 2, an apparatus 1 for extracting energy from a pressured gas by a centrifugal piston expander is illustrated. Such apparatus is mounted on a circular plate or body 10 which in turn is keyed to a shaft 2 which is rotated by a suitable electric or fluid pressure motor 3. A conventional fluid shaft coupling 4 effects the supply of pressured gas to the apparatus 1 from a stationary supply pipe 4*a* through a hollow bore portion 2*a* of the shaft 2 and into a distributor 6.

A plurality of cylinder elements 20 are rigidly mounted on the rotating body plate 10. Each said cylinder element defines a fluid pressure chamber 20*a* having a linear longitudinal axis which extends from a point proximate to the axis of rotation of the body 10 to a point radially remote from the axis of rotation. Each longitudinal axis of the fluid pressure chambers 20*a* is, however, not radially disposed with respect to the axis of rotation of shaft 2, but is spaced therefrom.

To optimize the performance of apparatus 1, as many of the cylinders 20 are applied to the rotating body plate 10 as can be physically accommodated thereon. The exact number employed depends upon a number of design factors, such as the pressure and volume of the gas that is available to power the unit, the space available to accommodate the unit, the gas cooling desired, and the weight limitations for the unit. Obviously, the larger the diameter of the individual cylinders 20, the smaller will be the total number of such cylinders that can be physically mounted on body plate 10. Likewise, the length of the cylinders 20 substantially increases the centrifugal forces acting on such cylinders and thus requires an increase in weight and strength of the cylinder components 20 as well as the body mounting plate 10 and the shaft 2. In the specific example illustrated in the drawing, six of such cylinder units are shown, and they are respectively secured to body plate 10 by bolted bands 21.

A free piston 25 (FIG. 2) is mounted in each of the fluid pressure chambers 20*a* defined by the cylinders 20 for slidable and sealable movements therealong. Since the bore or fluid pressure chamber 20*a* of cylinder 20 is of cylindrical configuration, conventional piston rings 25*a* may be employed on the piston 25 or, alternatively, the pistons could be provided with an external coating of an organic material having good lubricating and sealing properties, such as polytetrafluoroethylene, sold under the DuPont trademark "Teflon" or a perfluoroelastomer, sold under the DuPont trademark "Kalrez". Pistons 25 are preferably formed from a ferromagnetic material or incorporate a permanent magnet for control purposes to be hereinafter discussed.

At the outer end of each cylinder 20, an outwardly projecting flange 20*d* is provided to permit an outer cylinder head 26 to be secured thereto by suitable bolts (not shown). Mounted on each cylinder head 26 are a pair of solenoid actuated valves 33 and 35 which respectively function as inlet and outlet valves for the fluid pressure chamber 20*a*. Each inlet valve 33 is connected by a conduit 6*a* to the distributor 6. If the particular temperature and pressure conditions of the expanded exhaust gas make it desirable to use such as a cooling medium, then each outlet valve 35 can connect by conduit 28 and collector 7 to a heat exchange device in the manner described in detail in the aforementioned co-pending patent applications. If the compressed gas is air, the cooled exhaust gas can be discharged into a room.

Additionally, the inner ends of each of the cylinders 20 is provided with a radial flange 20*b* on which is mounted a inner cylinder head 27. Centrally mounted on each inner cylinder head 27 is a solenoid actuated piston cushioning valve 36. The construction of each of the solenoid actuated valves 33, 35 and 36 is identical to that described in the above identified pending patent applications and hence will not be described in any further detail.

From the description thus far, it will be apparent that the free pistons 25 move to the outermost positions in the respective fluid pressure chambers 20*a* by the centrifugal force generated by the rotation of shaft 2 by the motor 3. When the pistons 25 reach their outermost position, then through the operation of a control circuit to be hereinafter described, the solenoid actuated inlet valves 33 are actuated to an open position and permit a charge of pressured gas to be introduced into the fluid pressure chambers 20*a*. If the pressure of such gas charge is sufficiently high, each piston will be stopped in its outward movement and moved inwardly against the centrifugal force bias by the pressure force exerted by such gas on the piston. Obviously, as each piston 25 moves inwardly, the centrifugal force acting on the piston decreases, so that once inward motion of the piston is started, it will continue.

As the pistons 25 approach the inner ends of the fluid pressure chambers 20*a* defined by the inner cylinder heads 27, then through the operation of a control circuit hereinafter described, the valve 36, which is normally open, is actuated to close and thus trap the air remaining in the fluid pressure chamber between the closed inner end of the chamber 20*a* and the oncoming face of the free piston 25. Such trapped gas acts as a cushion to arrest the movement of each free piston 25 prior to the piston impacting against the inner cylinder head 27.

Once the inward motion of the free pistons 25 is arrested, then through the operation of the control circuit to be described, the piston cushion valve 36 may be returned to an open position to exhaust the high pressure developed in the inner ends of each fluid pressure chamber 20. Alternatively, such valve may be retained in a closed position for a period so as to permit the high pressure developed therein to act on the free piston 25 and assist centrifugal force in returning the free piston to its outermost position in the fluid pressure chamber 20*a*. In any event, the free piston 25 returns to its outermost position and, as it approaches such outermost position, the described cycle of operations is repeated.

During the return movements of the free piston 25 to their outermost positions, the respective exhaust valves 35 are shifted by the control circuit to an open position so that such outward movement is substantially unimpaired until each piston approaches its outermost position. At that point, a choice of operations is available. The outward movement of the piston may be arrested solely by closing the exhaust valve 35 and opening the inlet valve 33. Alternatively, both of the valves may be retained in a closed position, thus trapping the remainder of the gas in the outer end of the fluid pressure chamber 20*a* and arresting the outward motion of the free piston 25 by such trapped gas, following which the inlet valve 33 may be opened to introduce a fresh charge of pressured gas as the free piston 25 initiates its inward movement.

Figure 5:
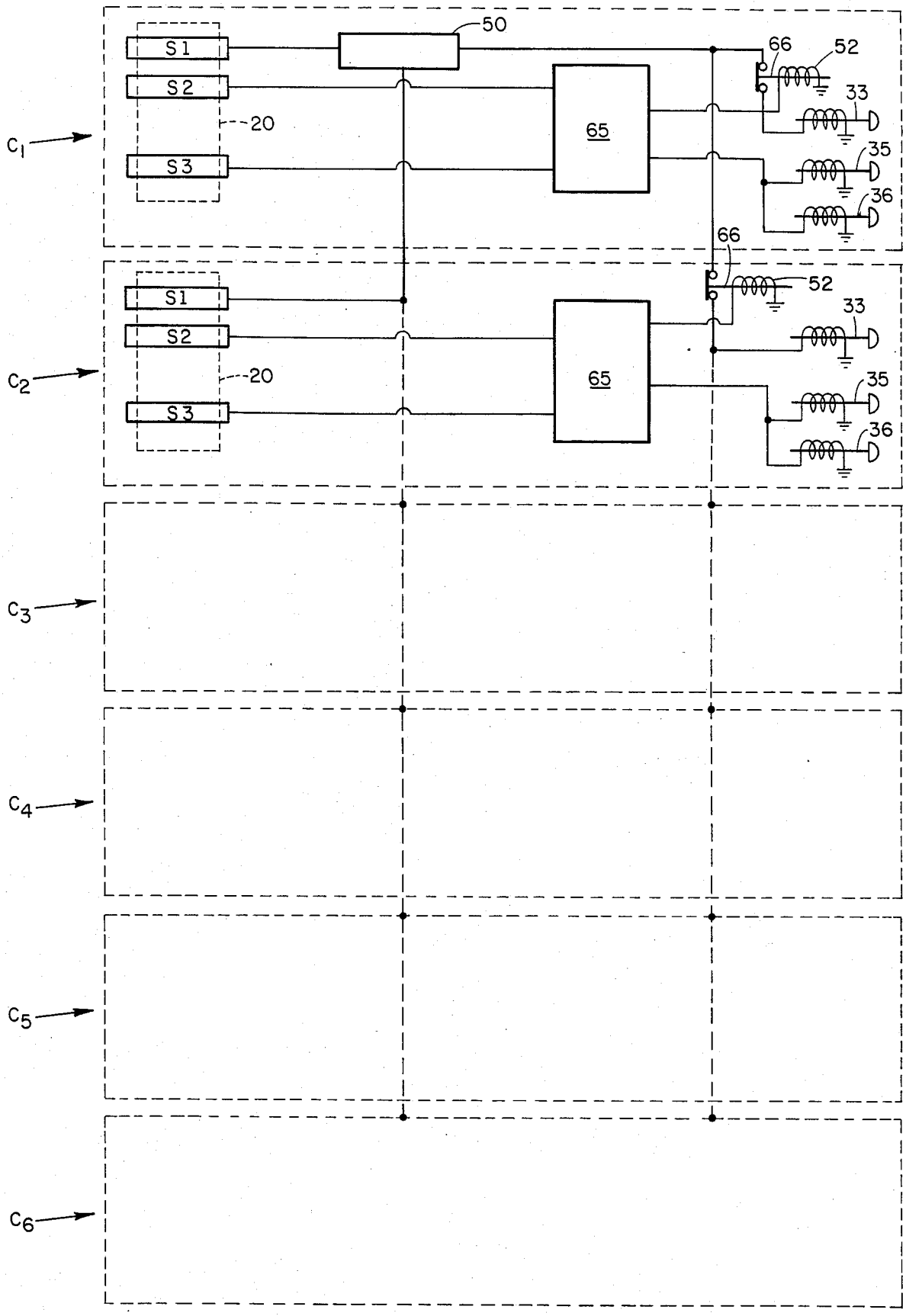
FIG. 5 is a schematic view of a control circuit usable with the centrifugal piston expanders of FIGS. 1–4.

Referring now to FIG. 5, there is shown a schematic control circuit for operating each of the solenoid control inlet valves 33, which circuits are respectively labelled C1, C2 . . . C6. A pair of sensing devices S1 and S2 are provided on each of the cylinders 20 in order to respectively provide a signal when the respective free piston 25 is adjacent the position of such sensing device. Sensing device S1 is preferably located to provide a signal when the free piston 25 is close to its outermost or its most remote position relative to the rotational axis. All such signals are supplied to a conventional electronic circuit 50 known as an "AND" circuit, which will produce an amplified output signal for concurrent application to all of the solenoid controlled inlet valves 33 only when all of the free pistons 25 have reached their outermost positions. It is thereby assured that all such pistons are energized at the same instant, thus providing for substantially synchronous inward movement of the free pistons and hence maintaining the dynamic balance of the rotatable assemblage.

The second set of sensors S2 are respectively mounted on the cylinders 20 at a position radially inward from the sensors S1. The exact location of the sensors S2 depends upon the amount of pressured gas that it is desired to be applied to each fluid pressure chamber 20*a*. Sensors S2 are connected through a logic circuit 65 to operate relays 52 which opens contacts 66 to interrupt the supply of actuating current to the solenoid controlled inlet valves 33. Thus, the length of time that the fluid pressure chambers 20*a* are connected to a source of pressured gas may be conveniently varied by varying the position of the sensors S2 respectively on the cylinders 20, or more accurately, varying the position at which the respective free pistons 25 will effect the actuation of the sensors S2 to cause closing of the respective inlet valve 35.

The control circuit illustrated in FIG. 5 also provides for the operation of the solenoid controlled exhaust valves 35 and piston cushion valves 36 at the proper intervals as determined by the position of the free piston 25 in the respective fluid pressure chambers 20*a*. Such operation may be accomplished through the addition of a third sensor S3 to each of the cylinders 20 at a position near the inner or axis proximate end of the fluid pressure chamber 20*a*. Thus, sensor S3 detects when the respective free piston 25 is approaching its extreme inward or axis proximate position. When each free piston 25 arrives at such position the signal generated by the respective sensor S3 operates through a conventional logic circuit 65 to effect the opening of the respective exhaust valve 35 and the closing of the piston cushion valve 36. A conventional locking circuit (not shown) holds primary exhaust valve 35 open until sensor S1 is actuated by the return of piston 25. The removal of the free piston 25 from the vicinity of the respective sensors S3 provides a signal to effect the opening of the piston cushion valves 36 since it is then apparent that the inward movement of the free pistons 25 has been arrested and such pistons are ready to resume their outward movements.

From the foregoing description, it will be apparent to those skilled in the art that the described centrifugal piston expander will function to effect any desired speed of reciprocation of the free pistons 25 without incurring any risk of damage resulting from impact of any free piston with the inner or outer ends of its respective cylinder. Thus, a significant disadvantage of prior centrifugal piston expanders has been effectively overcome.

A preliminary computer evaluation of the output torque developed by a centrifugal piston expander constructed and operated in accordance with the modification of FIGS. 1, 2 and 5 reveals that for many combinations of variables involved in the construction and operation, the torque applied the rotating shaft 2, due to the operation of the free pistons, is characterized by large swings of torque cylically applied to the rotating cylinders.

Figure 3:
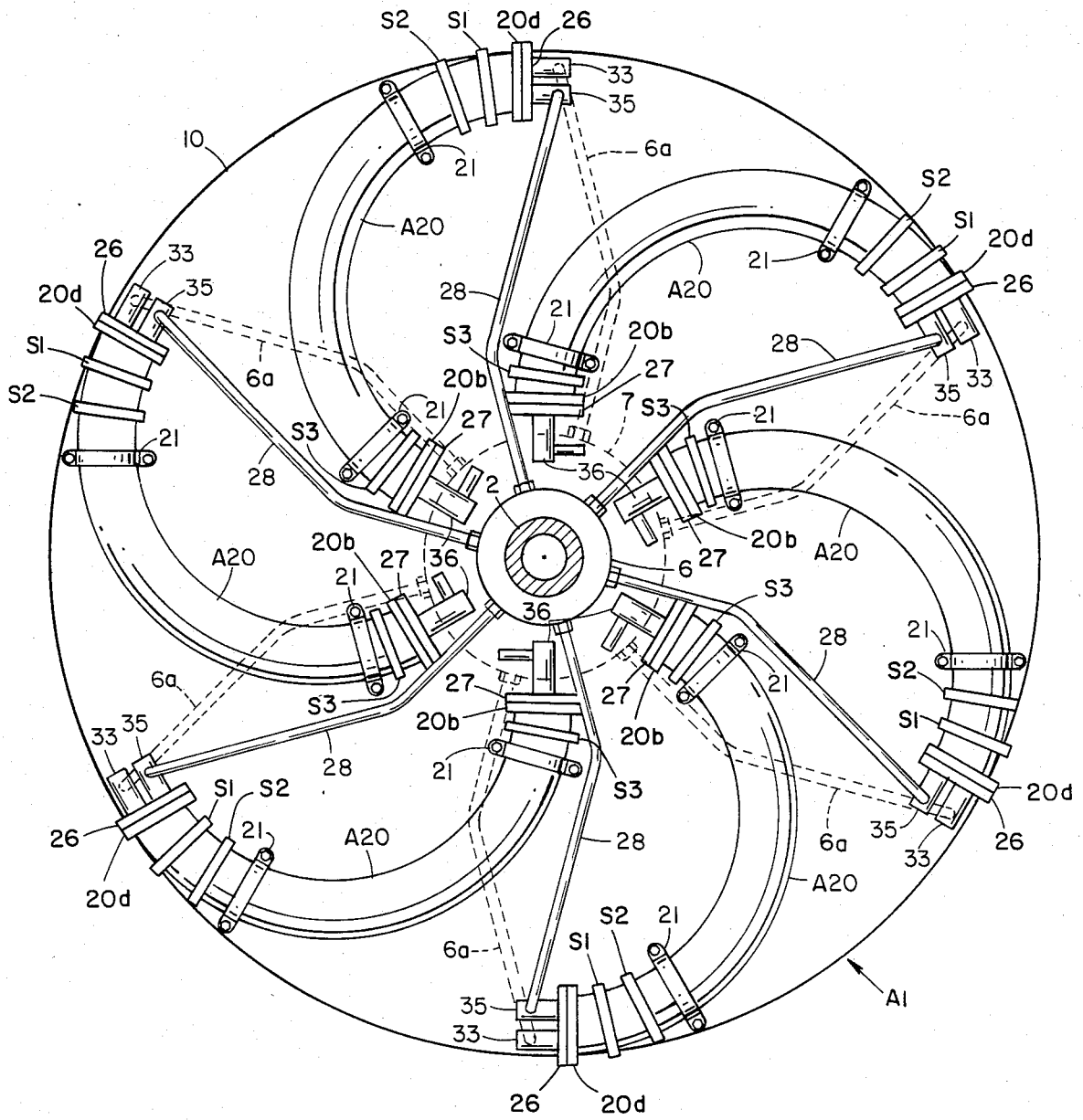
FIG. 3 is a view similar to FIG. 2 of a centrifugal piston expander employing fluid pressure chambers having an arcuate, longitudinal axis.

The principles of this invention may be applied to any form of centrifugal piston expander irrespective of whether the cylinders have a linear or arcuate longitudinal configuration. Thus, as illustrated in FIG. 3, the centrifugal piston expander A1 can include a plurality of cylinder elements A20 which have a longitudinally curved configuration. Because of such curvature, the pistons A25 must, of course, be constructed with either an ellipsoidal or spherical external configuration. Typical pistons for use in such curved cylinders are disclosed in the above identified co-pending applications.

Otherwise, the location of the sensor elements S1, S2 and S3 to detect the position of the respective free pistons 25*a* is substantially identical to that disclosed in connection with the modification of FIGS. 1 and 2, and the method of operation of the centrifugal piston expander of FIG. 3 proceeds in accordance with the method already described.

Figure 4:
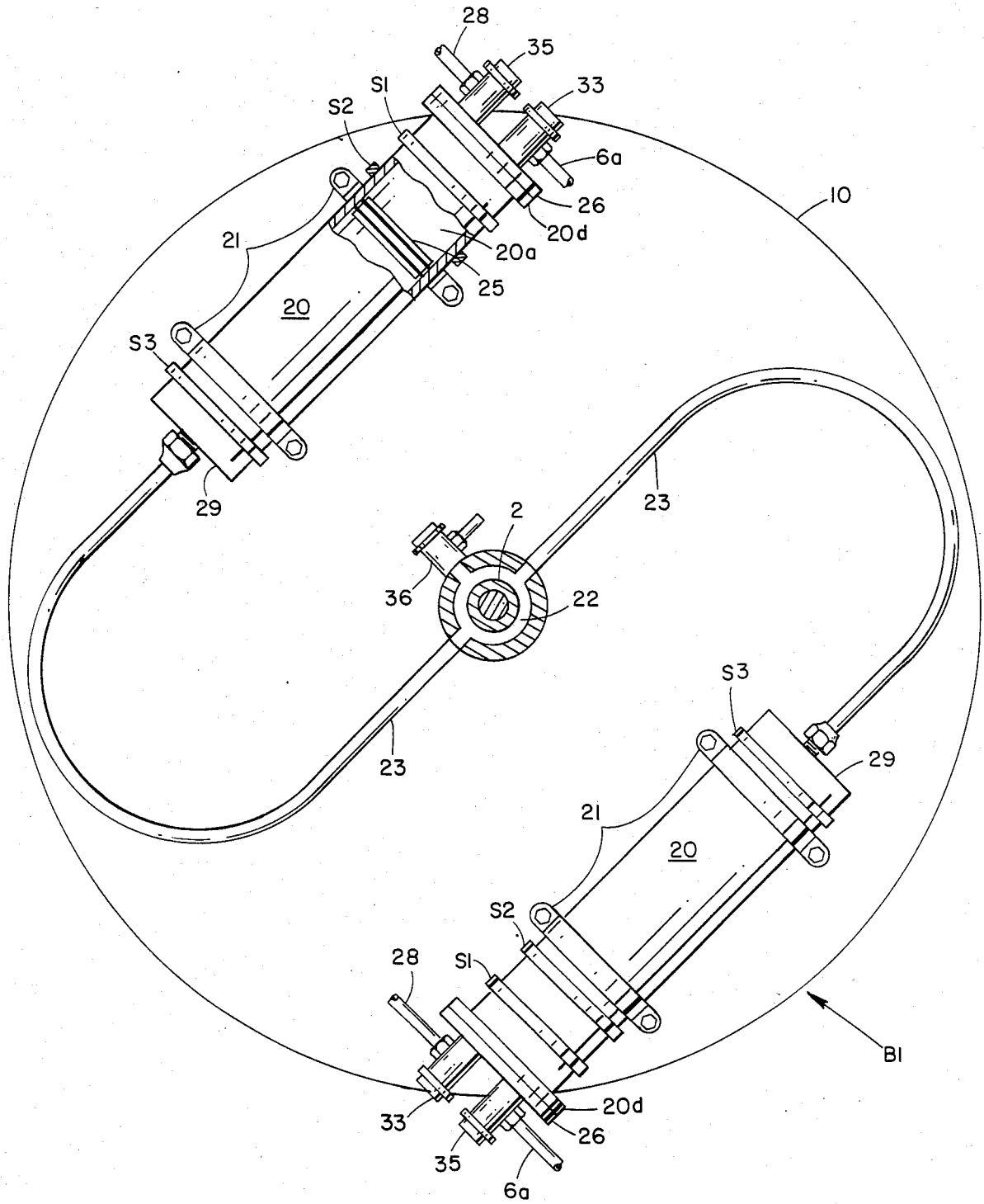
FIG. 4 is a view similar to FIG. 2 of a centrifugal piston expander having opposed linear cylinders with the inner ends connected to a common valve for arresting inward movement of the pistons.

Referring now to FIG. 4, there is shown a centrifugal piston expander B1 which is similar to the construction of the expander shown in FIGS. 1–2 and similar numerals indicate identical components. Instead of providing a separate piston cushioning valve 36 for each of the cylinder elements 20, in the modification of FIG. 4, the inner ends of the fluid pressure chambers 20*a* are interconnected by conduits 21 respectively extending to a common chamber 22 which is mounted in any convenient location on the rotating body plate 10. A single solenoid actuated piston cushioning valve 36 is then provided to connect the chamber 22 to atmosphere.

The operation of the modification of FIG. 4 is very similar to that already described in that the piston cushioning valve 36 is actuated to its closed position by any one of sensors S3 upon the movement of the free pistons 25 into close proximity to the inner ends of the cylinder elements 20. Since the fluid volumes involved in conduits 21 and the common chamber 22 are relatively small, once the piston cushioning valve 36 is closed, the pressure in such elements rapidly increases and reaches a sufficient value to arrest the inward movements of the free pistons 25 before they strike the inner cylinder head 29. Obviously, the control circuit in FIG. 5 should be modified so that the signals generated by the sensors S3 are connected in an "OR" relationship so that when any one of the free pistons 25 reaches the desired inward position for actuating the piston cushioning valve 36, such valve will be closed even though the remaining pistons may be slightly behind the piston that caused the actuation.

The cyclically varying torque developed by centrifugal piston expanders embodying this invention may be utilized to drive a so-called "smart" generator (not shown) which is known in the art and embodies computer control of the field excitation of the generator to compensate for the varying speed drive and produce a usable direct or alternating current output.

It should be recognized that in place of introducing a charge of pressurized gas into the fluid pressure chamber in any of the modifications of this invention, an alternative procedure would be to introduce a charge of combustible gas and air which is then ignited by a suitable spark plug disposed in each outer end of the fluid pressure chamber cylinder. The resulting explosion will produce a charge of highly pressured gas to effect the driving of the free piston towards the end of the cylinder more proximate to the axis of rotation.

Although the invention has been described in terms of specified embodiments which are set forth in detail, it should be understood that this is by illustration only and that the invention is not necessarily limited thereto, since alternative embodiments and operating techniques will become apparent to those skilled in the art in view of the disclosure. Accordingly, modifications are contemplated which can be made without departing from the spirit of the described invention.

What is claimed is:

1. Apparatus for extracting energy from a pressured gas comprising: a body rotatable about an axis; power means for rotating said body; a cylinder element secured to said rotating body; said cylinder element defining an elongated fluid pressure chamber; a free piston movable longitudinally in said fluid pressure chamber; said cylinder element being fixed on said rotatable body with the path of movement of said free piston extending from a position proximate to said axis to a position remote from said axis; whereby centrifugal force will move said free piston to said remote position; said path of movement being substantially non-radially disposed relative to said axis of rotation; inlet valve means communicating between a source of pressured gas and the remote end of said cylinder element; means for opening said inlet valve means only when said free piston is adjacent said remote position to receive a charge of pressured gas in said fluid pressure chamber, thereby moving said free piston inwardly toward said rotational axis; exhaust valve means communicating with said fluid pressure chamber and operable only when said free piston approaches said proximate position; and means on the radially inner end of each said cylinder element for opposing the inward movement of said free piston by a trapped gas column to thereby stop the inward movement of said free piston.

2. The apparatus of claim 1 wherein said means on the radially inner end of each said cylinder element comprises a valve normally open to atmosphere but closable to trap air between said free piston and the radially inner end of said cylinder to stop the inward movement of said free piston.

3. Apparatus for extracting energy from a pressured gas comprising: a body rotatable about an axis; power means for rotating said body; a pair of cylinder elements secured to said rotating body in diametrically opposed positions relative to said rotational axis; each said cylinder element defining an elongated fluid pressure chamber; a free piston movable longitudinally in each said fluid pressure chamber; said cylinder elements being fixed on said rotatable body with the path of movement of each said free piston extending from a position proximate to said axis to a position remote from said axis; whereby centrifugal force will move said free pistons to said remote positions; each said path of movement being substantially non-radially disposed relatively to said axis of rotation; inlet valve means communicating between a source of pressured gas and the remote end of each cylinder element; means for opening said inlet valve means only when said free pistons are respectively adjacent said remote positions to receive a charge of pressured gas in the respective fluid pressure chambers; thereby moving said free pistons inwardly toward said rotational axis; exhaust valve means respectively communicating with said fluid pressure chambers and openable only when said free pistons respectively approach said axis proximate position; and means on the radially inner end of each said cylinder element for producing a column of trapped gas for opposing radially inward movement of said free pistons to thereby stop the inward movements of said free pistons.

4. The apparatus of claim 3 wherein said means on the radially inner end of each cylinder element comprises a conduit interconnecting the inner ends of said diametrically opposed cylinder elements.

5. The apparatus of claim 4 further comprising a normally open valve in said conduit, and means for closing said normally open valve as said free pistons approach the inner ends of said fluid pressure chambers.

6. Apparatus for extracting energy from a pressured gas comprising: a body rotatable about an axis; power means for rotating said body; a plurality of cylinder elements secured to said rotating body in an equi-spaced array around said axis; each said cylinder element defining an elongated fluid pressure chamber; a free piston movable longitudinally in each said fluid pressure chamber; said cylinder elements being fixed on said rotatable body with the path of movement of each said free piston extending from a position proximate to said axis to a position remote from said axis; whereby centrifugal force will move said free piston to said remote position; each said path of movement being substantially non-radial relative to said axis of rotation; inlet valve means communicating between a source of pressured gas and the remote end of each said cylinder element; means for opening said inlet valve means only when said free pistons are respectively adjacent said remote positions to receive a charge of pressured gas in the respective fluid pressure chambers, thereby moving said free pistons radially inwardly; first exhaust valve means respectively communicating with said fluid pressure chambers and operable only when said free pistons respectively approach said axis proximate position; and a third valve means on the radially inner end of each said cylinder element for trapping air between said free piston and said radially inward end of said cylinder to stop the inward movement of said free piston.

7. The method of operating a centrifugal piston expander to extract heat and mechanical energy from a pressured gas, said expander having at least one elongated cylinder mounted for rotation about an axis and defining an elongated fluid pressure chamber extending from a point remote from the rotational axis to a point proximate to the rotational axis, and a free piston slidably and sealably mounted in the fluid pressure chamber, comprising the steps of:

(1) rotating the cylinder to move the free piston by centrifugal force to the radially outer end of the fluid pressure chamber;

(2) introducing a charge of pressured gas in the radially outer end of the fluid pressure chamber, thereby moving the free piston inwardly and rotating said cylinder about said axis to produce an output torque;

(3) closing a normally open exhaust valve in the inner end of the fluid pressure chamber to provide a trapped volume of air to stop the inward movement of the free piston; and (4) continuously repeating steps 1–3.

8. The method of claim 7 plus the step of opening said exhaust valve after the free piston initiates its return outward movement.

9. The method of claim 7 wherein the torque produced by the rotation of said cylinder varies cyclically.

* * * * *